US005582570A

United States Patent [19]

Crowley

[11] Patent Number: 5,582,570

[45] Date of Patent: Dec. 10, 1996

[54] METHOD AND APPARATUS FOR BINDING SHEETS USING A PRINTING SUBSTANCE

[75] Inventor: H. W. Crowley, Newton, Mass.

[73] Assignee: Roll Systems, Inc., Burlington, Mass.

[21] Appl. No.: 313,753

[22] Filed: Sep. 28, 1994

Related U.S. Application Data

[63] Continuation-in-part of Ser. No. 261,604, Jun. 17, 1994, Pat. No. 5,456,646, and a division of Ser. No. 44,972, Apr. 8, 1993, Pat. No. 5,328,438, which is a division of Ser. No. 702,829, May 20, 1991, Pat. No. 5,213,560.

[51] Int. Cl.[6] ..... B31B 1/24; B31B 1/62

[52] U.S. Cl. ..... 493/187; 493/264; 493/332; 493/320; 156/277

[58] Field of Search ..... 270/53; 493/187–190, 493/197, 202, 235, 239, 254, 264, 265, 320, 325, 332, 333, 208, 249, 266, 336, 337, 220, 231, 917, 919, 920, 921; 156/217, 227, 277

[56] References Cited

U.S. PATENT DOCUMENTS

| | | |
|---|---|---|
| 1,636,495 | 7/1927 | Widmaier . |
| 2,242,799 | 5/1941 | Moore . |
| 3,794,550 | 2/1974 | Taillie . |
| 3,794,554 | 2/1974 | Taillie . |
| 4,343,673 | 8/1982 | Smith et al. . |
| 4,398,986 | 8/1983 | Smith, Jr. . |
| 4,513,993 | 7/1985 | Bradley . |
| 4,726,802 | 2/1988 | Volk, Jr. . |
| 4,818,332 | 4/1989 | Shultz et al. . |
| 4,826,475 | 5/1989 | Eweryd . |
| 5,048,809 | 9/1991 | Tebbe . |

FOREIGN PATENT DOCUMENTS

| | | |
|---|---|---|
| 0193726 | 10/1986 | European Pat. Off. . |

*Primary Examiner*—Jack W. Lavinder
*Attorney, Agent, or Firm*—Cesari and McKenna

[57] ABSTRACT

A method and apparatus for binding sheets using a reactivatable printing substance such as toner comprises a printing device for applying printing toner to a binding edge of a sheet. Printing text can be applied simultaneously to the sheet by the printing device. The sheet is transferred through a preheat station to an overlay location where additional sheets having strips of toner adjacent to a binder edge thereof are overlaid, one at a time. As each sheet is overlaid, the toner strip on the preceding sheet is fused to the uppermost sheet or by another from of sealing energy. Such fusing can be accomplished using a heated platen or wheel that bears upon the uppermost sheet. An opposing toner strip can be applied to the lower face of the uppermost sheet so that a pair of opposing toner strips on each of the opposing sheets are fused to each other.

31 Claims, 9 Drawing Sheets

METHOD AND APPARATUS FOR BINDING SHEETS USING A PRINTING SUBSTANCE

RELATED APPLICATION

This application is a continuation-in-part application and patent application Ser. No. 08/261,604, filed on Jun. 17, 1994, now U.S. Pat. No. 5,456,646, is a divisional application of Applicant's U.S. patent application Ser. No. 08/044,972, filed Apr. 8, 1993, now U.S. Pat. No. 5,328,438, which is a divisional application of U.S. patent application Ser. No. 07/702,829, filed May 20, 1991, now U.S. Pat. No. 5,213,560, issued May 25, 1993.

FIELD OF THE INVENTION

The present invention relates generally to a method and apparatus for binding sheets using a printing substance such as toner.

BACKGROUND OF THE INVENTION

It has been recognized that many printing substances, such as ink and toner (as used in xerography and laser printing) is, in essence, an adhesive particularly suited to adhere to paper and other web material. Applicant's U.S. Pat. No. 5,213,560, which is expressly incorporated by reference herein, discloses a method and apparatus for utilizing printing toner, applied by a printing device, as a mechanism to seal a folded sheet to form a completed envelope or package. According to this disclosure, a sheet is provided with printed text and strategically-placed strips (of various printed patterns) of toner, typically along edges of the sheet. The toner strips are subsequently heated and the sheet is folded so that the toner strips overlap a folded section of the sheet. The toner is sealed under heat and pressure to create a completed sealed envelope or package. When the toner cools, the sealed envelope can be mailed like a conventional preformed envelope having contents therein.

By using toner as an adhesive, mailers can be produced from single sheets, reducing waste that normally results from the use of separate preformed envelopes. The single sheets can be derived from a continuous source of web such as a roll, expediting the mailer production process. The roll can be driven continuously through a printing device which lays down both text and adhesive toner strips in one step. Further perforations can be provided before or after printing that enhance the ease of opening the finished mailer. As disclosed in applicant's above-described patent, windows can also be formed in the sheets that include toner spots to facilitate the tacking of the window edge to an opposing surface of the mailer.

It has been contemplated that toner can provide an adhesive for binding a plurality of sheets together to form a book or pamphlet. In this instance, toner is applied in a strip to an edge of each sheet and the sheets are overlayed in groups while the edge is heated to cause the toner strips to fuse to adjacent sheet edges. Such a binding method is disclosed in U.S. Pat. No. 4,398,986 to Smith Jr., et al. This method involves the grouping of several sheets together in the presence of a heated platen that melts and the toner. A disadvantage of this method is that the platen often provides extreme heat to the outer sheets of the stack while not sufficiently heating the innermost sheets of the stack. When several groups of prebound stacks are, subsequently, grouped together, the uneven heating is more pronounced hence, the practical thickness of sheets of a bound stack utilizing this method is relatively small.

It is, therefore, an object of this invention to provide a method and apparatus for binding sheets utilizing printing toner that provides a uniform binding strength to all sheets in a stack regardless of stack thickness.

SUMMARY OF THE INVENTION

A method and apparatus for binding sheets using a printing substance, such as toner, comprises utilizing a printing device to apply the substance or toner to a binding edge of a sheet. Printing, in the form of text, diagrams and figures, for example, can be applied simultaneously to the sheet by the printing device as binding strips are applied. As used herein the term "toner" shall be used interchangably with "printing substance." These terms should be taken broadly to define any visible ink-like print-forming compound that can adhere to a surface and be reactivated upon application of energy or chemical agents, as defined further below.

In one embodiment, the sheet is transferred through a preheat station to an overlay location where additional sheets having strips of toner adjacent to a binder edge thereof are overlaid, one at a time. As each sheet is overlaid, the toner strip on the preceding sheet is fused to the uppermost sheet. Such fusing can be accomplished using a heated platen or using a wheel that bears upon the uppermost sheet. An opposing toner strip can be applied to the lower face of the uppermost sheet so that a pair of opposing toner strips on each of the opposing sheets are fused to each other.

The toner strips on each of adjacent sheets can be located at different spacings relative to the binding edge so that the strips are offset from each other. In this manner, as the platen or wheel is located over one of the strips, it is free of contact with another of the strips. Thus, each pair of sheets are joined by an alternating binding strip, wherein fusing heat is concentrated in the closest binding strip.

A variety of toner strip configurations can be provided according to this invention. Such configurations can include a plurality of slashed lines, a plurality of dots, or a solid stripe of toner. In order to facilitate transfer of fusing heat through a sheet, the sheet can be wetted using a wetting solution such as a silicone-based oil.

BRIEF DESCRIPTION OF THE DRAWINGS

The foregoing and other objects and advantages of the invention will become more clear with reference to the following detailed description of the preferred embodiments as illustrated by the drawings in which.

DETAILED DESCRIPTION OF THE PREFERRED EMBODIMENT

Figure 1:
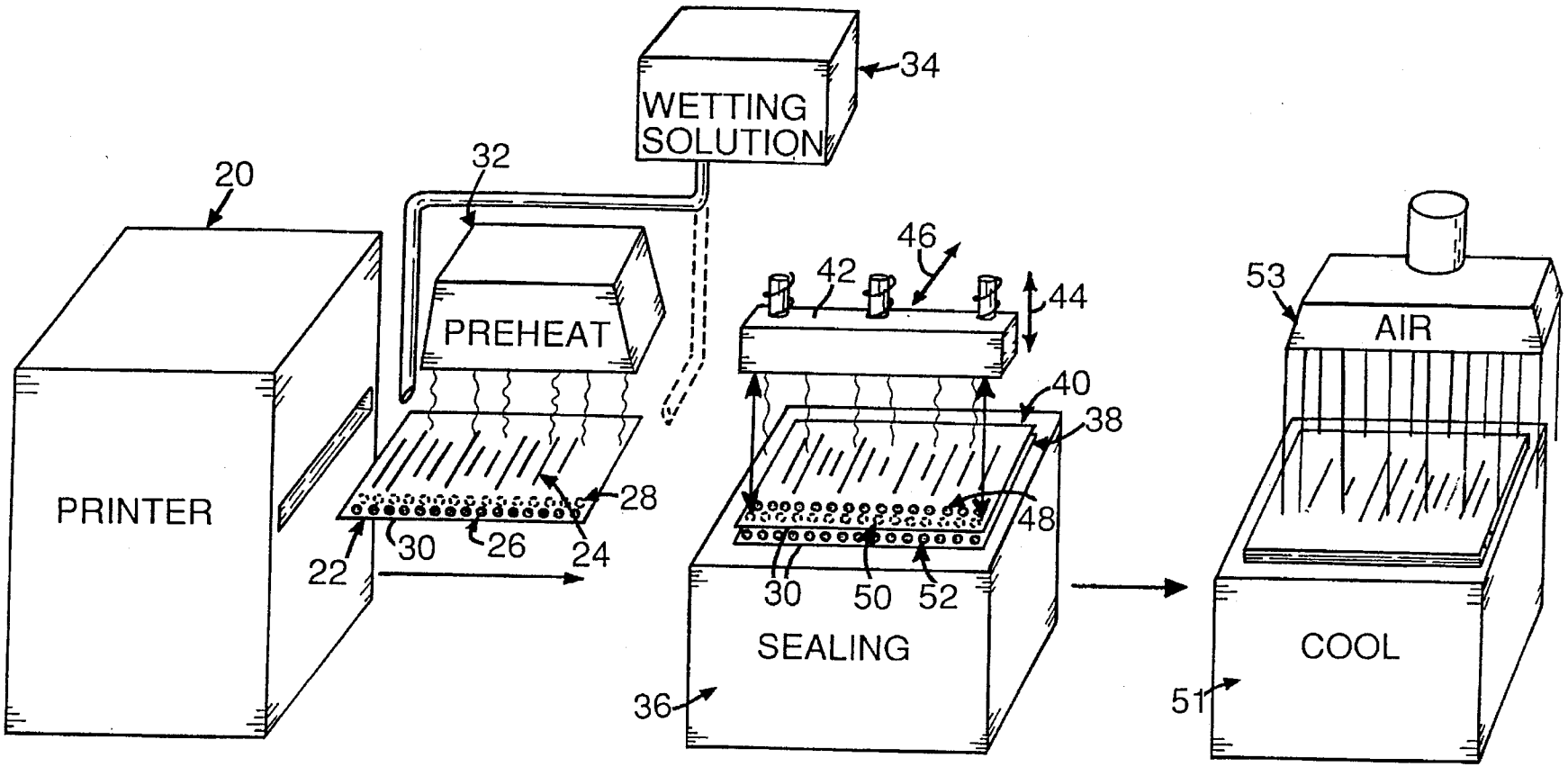
FIG. 1 is a schematic perspective view of an apparatus and method for binding sheets according to this invention.

An apparatus for binding sheets is detailed in FIG. 1. The apparatus comprises a printer 20 or similar image transfer device that applies toner, in the form of text and images, to web material comprised, typically, of sheets of paper. The toner, according to this embodiment can comprise a one-part or two-part matrix of polystyrene (small plastic pellets) and colorant, such as carbon black. As stated above, the term "toner" as used herein should be taken to describe any type of ink or printing substance including a wax-based colorant or ink-jet printing compound that is suitable for printing and that can be reactivated to adhere to surfaces upon application of heat, chemicals or another energy source. The toner or other printing substance used in accordance with this invention is activated and reactivated by application of energy. Such energy can be defined as, for example, pressure, heat, electricity, light, ultrasound, ultraviolet radiation, chemical or catalytic reactions, microwave radiation or induction heating (using for example a ferrous toner additive). The toner is laid out onto the sheets 22 generally in the form of text 24. According to this embodiment, the sheets are typically printed in duplex format on both faces thereof. Text may or may not be placed on both faces. Each sheet 22 generally includes, along an edge 30 thereof a pair of opposed toner strips 26 and 28 that, according to this embodiment, are offset from each other relative to the edge 30. By "offset", it is meant that one strip 26 is positioned closer to the edge 30 than the other strip 28. The strips do not generally overlap each other.

Each sheet 22 according to this embodiment passes from the printer 20 under a preheat station 32 that applies infrared radiation to all, or a portion of, the sheet. In general, the infrared radiation can be concentrated proximate the edge 30 of each sheet 22. The radiation serves to warm and soften the toner, which, in this embodiment is heat-activated toner. Alternatively, in the case of chemically-activated toner, a chemical softening agent can be provided.

Prior to preheating, or after preheating (as shown in phantom) a wetting solution can be applied to the edge 30 adjacent the toner strips 26 and 28. The wetting solution 34 increases the thermal conductivity of the web at the edge 30, thus enhancing the melting of toner by the preheating and the subsequent sealing process. Suitable wetting solution can comprise a silicone oil or other petroleum distillate. While water can be utilized petroleum distillate can be preferable since water tends to swell paper fibers, causing deformation of the sheet. Alternatively, any toner or printing substance according to this invention can utilize chemical or mineral additives that enhance the substance's ability to absorb activation energy. For example, ferrous compounds can be added to induction-heated toners or UV-absorbent compounds can be applied to UV-activated toners.

Each sheet is delivered from the preheat and wetting stations to a sealing station 36 in which a plurality of sheets 38 and 40 are overlaid with respective binding edges 30 in an aligned relationship. According to this embodiment, a movable, heated platen 42 is raised and lowered (double arrow 44) onto the binding edge adjacent the toner strips. As described further below, each sheet is printed so that an upwardly-facing toner strip is aligned on a lower sheet (38) for example, with an downwardly-facing toner strip on an upper sheet (40), for example.

The platen 12 is movable to overlay each of the offset toner strips (double arrow 46). In this embodiment, the platen is heated so it applies sealing heat to the binding edge 30 at the location of the toner strip. As each sheet is overlaid at the sealing station, the platen is lowered over the adjacent facing toner strips (38 and 40) to melt and seal the toner strips to each other whereby each successive page is sealed to the preceding pages in the stack. In other words, the platen 42 overlays a portion of the edge 30 from the currently upwardly-facing toner strip 48 and that overlays a toner strip 50 that is separated from the platen by the upper face of the sheet 40. Hence, the platen never directly contacts a given toner strip but, rather, transmits sealing heat through an opposing surface of the sheet into the lowermost face of the sheet wherein the toner is located. The heat serves to fuse the toner and the upper sheet 40 to the opposing toner strip 52 in the lower sheet 38.

The platen 42 has a width or surface pattern that prevents it from contacting the adjacent upwardly facing toner strip 48 on the upper sheet 40. As sheet 22 is moved onto the sealing station 36, its lower strip 28 overlays the upwardly facing strip 48 on the sheet 40 and the platen 42 is moved to overlay the strips 28 and 48. The platen 42 is moved into position to seal the strips together. The new upwardly facing strip 26 is then located to receive an opposing downwardly facing strip in a subsequently-delivered sheet. The printer can be programmed so that the lowermost and uppermost sheet in the stack are free of outer-facing toner strips since the uppermost and lowermost sheet can comprise the cover sheets for the bound stack. As each bound stack is completed, it is output to a cooling station 51 where the toner is allowed to harden. The cooling station can include a fan or other source of air flow 53 to enhance the cooling of bound stacks. Alternatively, stacks can cool via ambient air.

Figure 2:
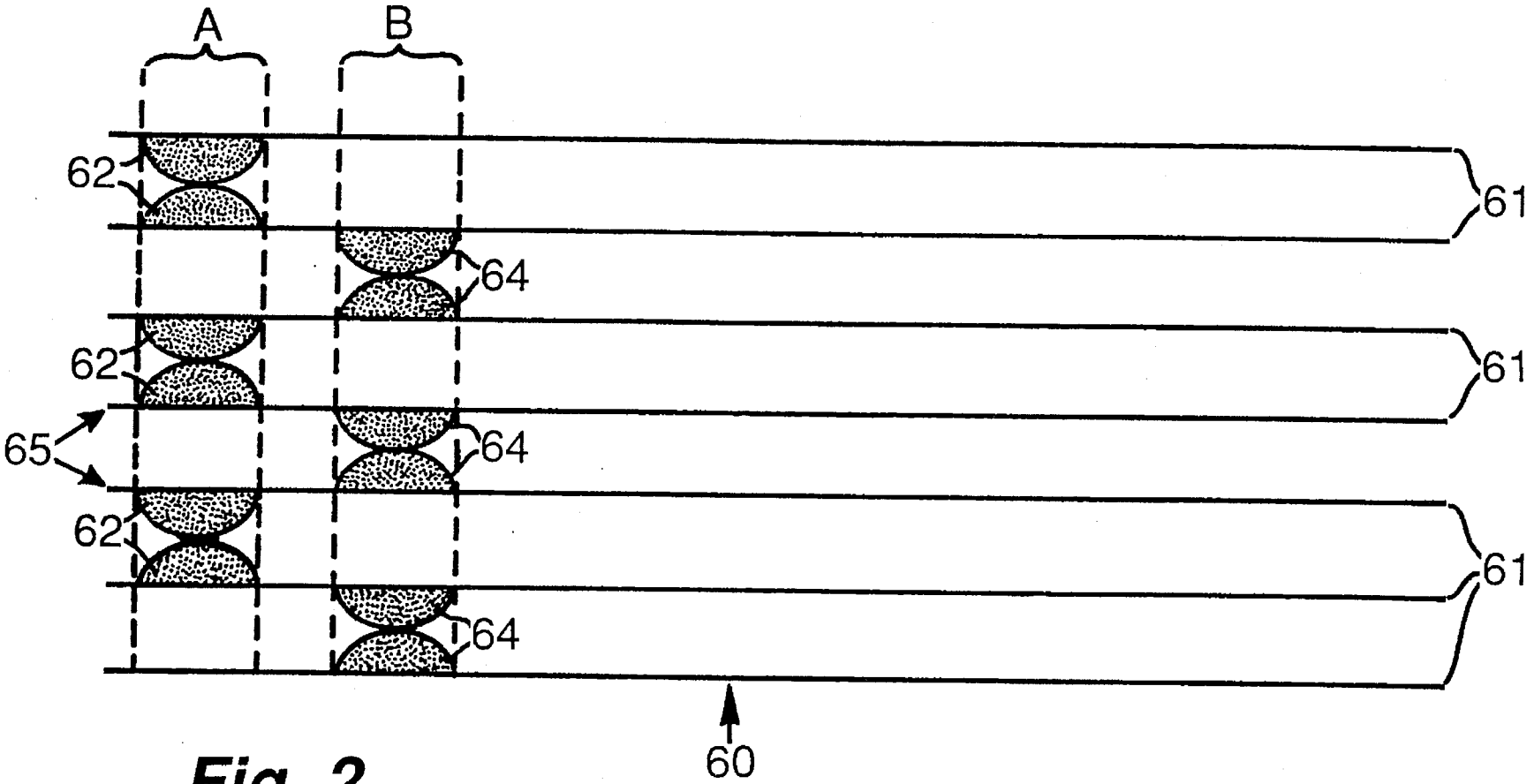
FIG. 2 is a side cross-section of a stack of bound sheets detailing the stack's binding edge or area according to this invention.

FIG. 2 illustrates a typical bound stack 60 according to this embodiment. The stack 60 comprises a plurality of sheets 61 bound along an edge by oppositely-facing toner strips 62 and 64. One set of facing toner strips 62 are aligned closer to the binding edge 65 in section A while an alternating set of facing strips 64 are aligned further from the edge 65 along section B. Sections A and B correspond roughly to "strip" locations according to this embodiment. As described above, an advantage of the binding process according to this embodiment is that each additional sheet that is overlaid onto the stack can be bound as it enters the stack. The sealing platen 42 is no more than one sheet width away from the toner. Thus, unlike prior art methods of binding, the platen 42 always delivers even, predictable, heat to each toner strip.

Binding, according to this embodiment, occurs continuously with every joint receiving an equal amount of heat to generate a uniform adhesion between toner strips. In addition, since each successive toner strip is alternated relative to the preceding strip, more heating energy is concentrated on the closest joint so that a maximum amount of sealing heat is transmitted between the two adjoining toner strips. However, it is contemplated that toner strips can be applied in an alternating arrangement so that all strips overlay a single location (i.e., all strips are located in either section A or in section B). According to a preferred embodiment, strips are alternated into a pair of non-overlapping sections for maximum sealing efficiency.

Figure 3:
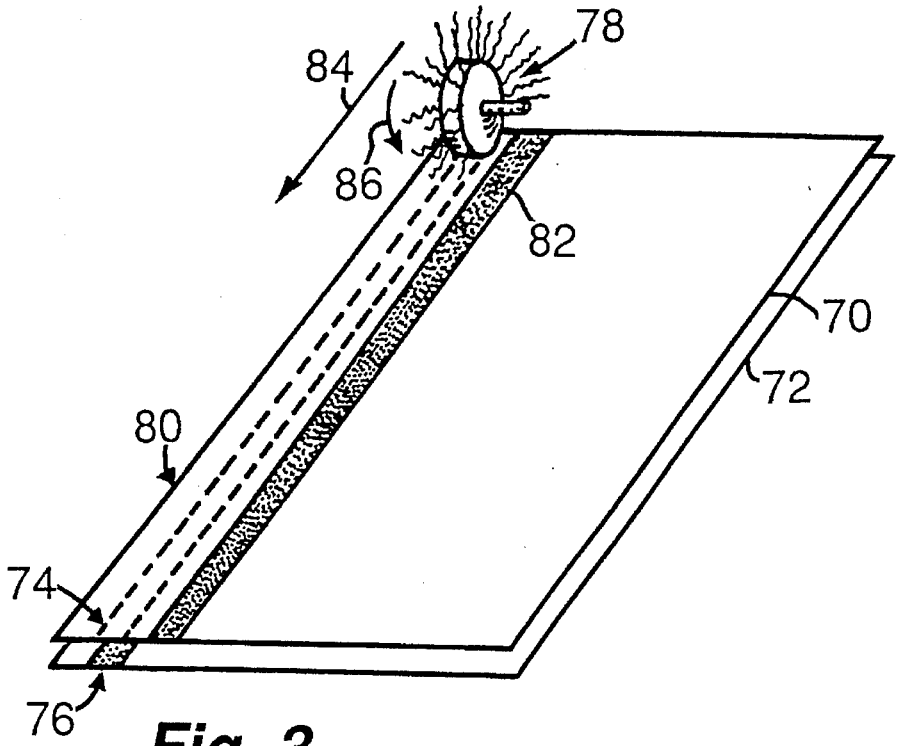
FIGS. 3 and 4 are schematic perspective views of a sealing process using a sealing wheel according to one embodiment of this invention.

While a platen 42 is detailed according to the preceding embodiment, a moving heated sealing wheel can be substituted for the platen 42. Such a sealing wheel 78 is detailed in FIGS. 3 and 4. A pair of sheets 70 and 72 are located in an overlaid relationship with respective toner strips 74 and 76 facing each other. The wheel 78 is positioned adjacent one end of the strip 74 and 76 over a portion of the edges 80 of the sheets 70 and 72 that is generally free of toner. Note that an adjacent offset strip 82 is provided on the upper sheet 70. The wheel 78 is remote from this strip 82. The wheel 78 passes (arrow 84) over the sheets 70 adjacent the edge 80 in a rolling motion (curved arrow 86). The wheel 78 applies pressure and heat adjacent the strips 74 and 76 so that the strips melt and become fused to each other.

Figure 4:
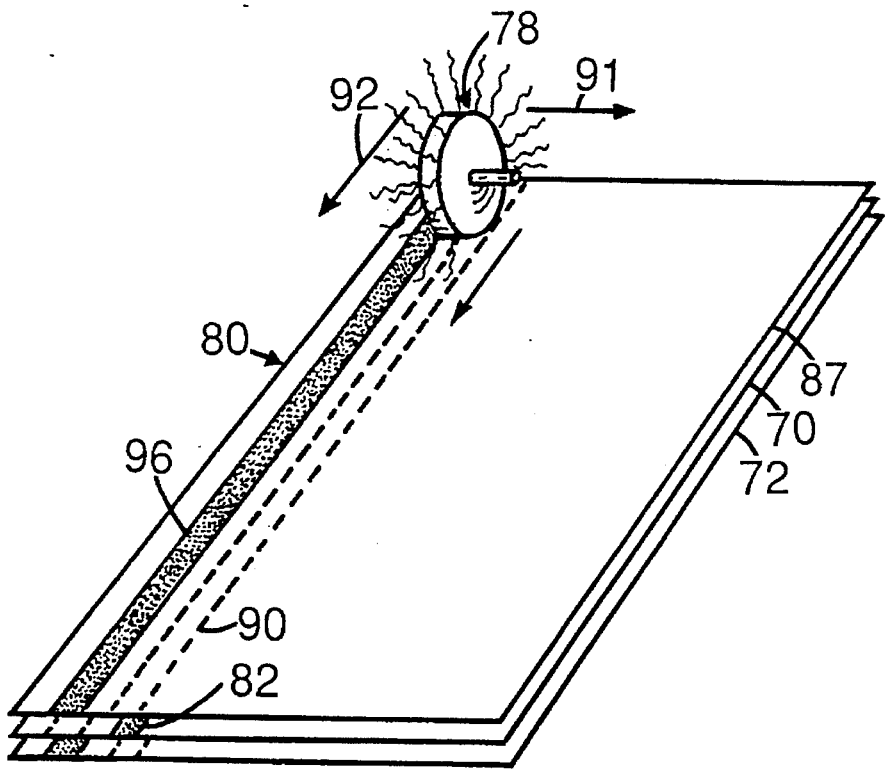

As further detailed in FIG. 4, an additional sheet 89 is overlaid onto the bound sheets 70 and 72. The wheel 78 is moved inwardly (arrow 91) from the edge 80 of the sheets (arrow 91) to a position overlaying the toner strip 82 on sheet 70 and the opposing toner strip 90 on sheet 89. The wheel 78 is again moved (arrow 92) along the strip providing sealing heat and pressure to fuse the toner strips 82 and 90. Another upwardly-facing toner strip 96 is provided to the uppermost sheet 89 in a position offset from the strips 82 and 90. Hence, a further sheet having an oppositely-facing toner strip can be provided over the uppermost sheet 89. The wheel 78 is moved to overlay the strip 96 when an additional sheet (not shown) is provided over the sheet 89. The sealing process described hereinabove continues until a complete bound stack is generated. As described above, each sheet receives an equal amount of sealing heat and pressure so that the stack is bound in a uniform and sturdy manner.

Figure 5:
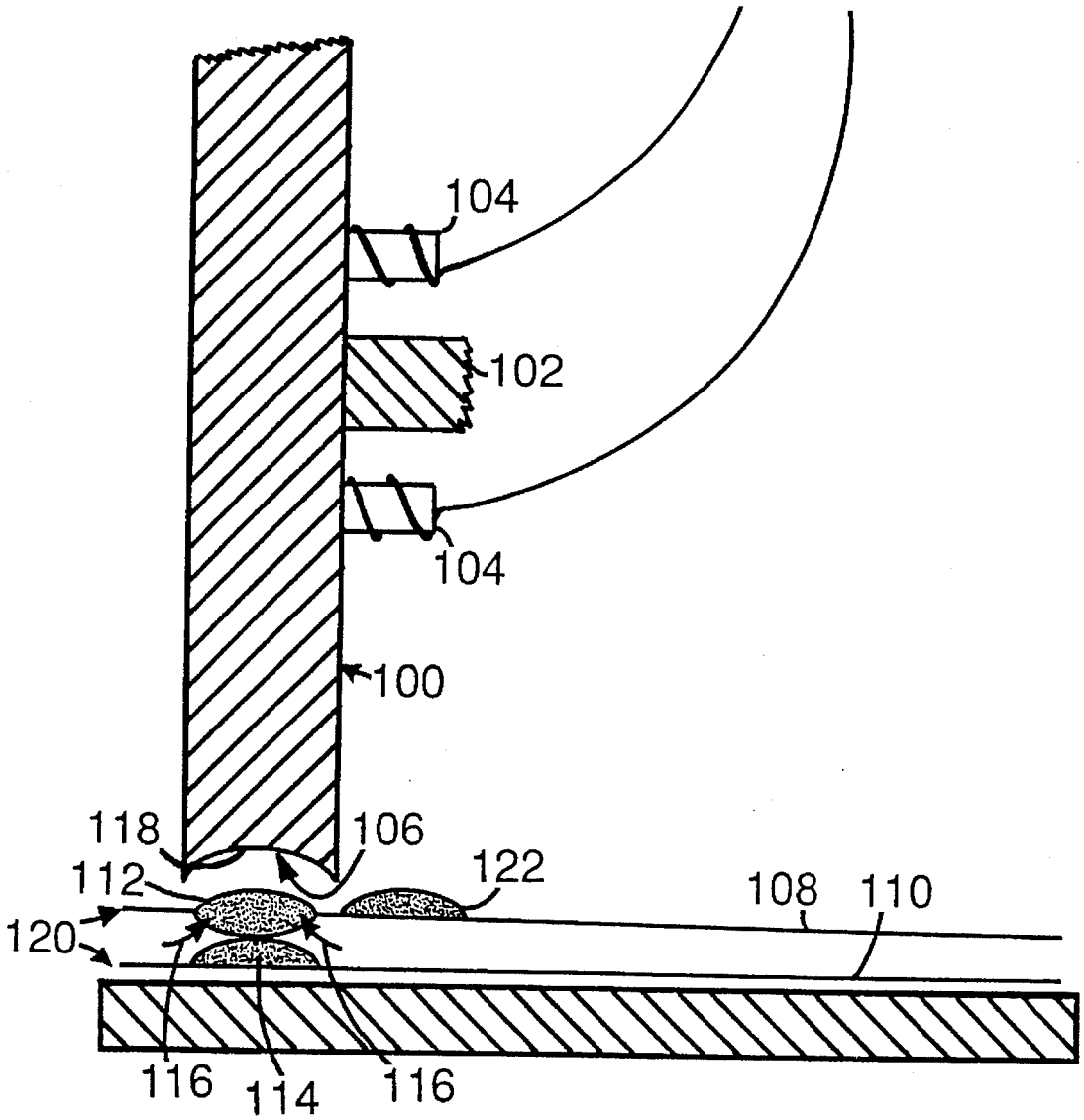
FIG. 5 is a side cross-section of a sealing wheel according to one embodiment of this invention.

FIG. 5 details an embodiment for a sealing wheel 100 according to this invention. The sealing wheel 100, like other sealing wheels herein, can be provided with heating coils along the wheel arbor 102, or at another desired location, such as the coil 104 located adjacent the arbor 102 as shown. The wheel 100 according to this embodiment includes a concave surface 106. When the wheel bears upon the sheets 108 and 110, the concave surface 106 causes encapsulation of the respective toner strips 112 and 114. Thus, as the toner melts, it is drawn (arrows 116) towards the center 118 of the concave surface 106. This insures that the toner is concentrated at the desired sealing location along the binding edge 120 and that the toner does not substantially flow into a position overlying the adjacent opposing toner strip 122.

As described above, the toner strip according to this embodiment can comprise a variety of geometric patterns. These patterns can be varied to change the adhesion properties and size of the binding area of sheets.

Figure 6:
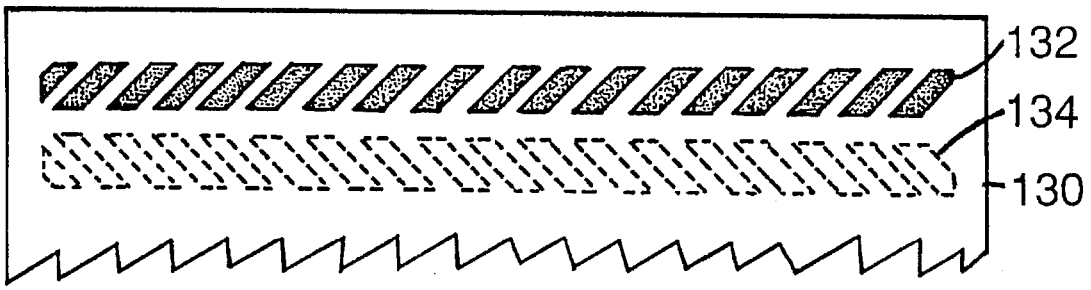
FIG. 6 is a plan view of a hatched toner strip pattern for forming a binding area according to one embodiment of this invention.

For example, FIG. 6 illustrates a sheet 130 having opposing toner adhesive strips 132 and 134 applied in an angled slashed pattern. Note that the strips 132 and 134 are angled in opposite directions. It is contemplated that oppositely-facing angled slashes can be overlayed to form a resulting cross pattern upon sealing.

Figure 7:
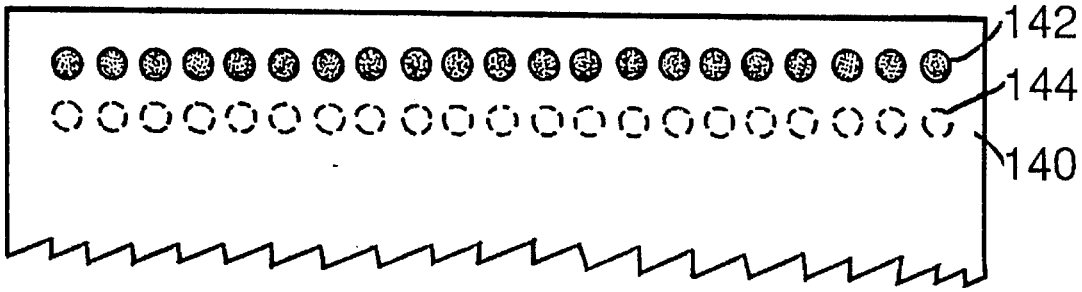
FIG. 7 is a plan view of a dotted toner strip pattern for forming a binding area according to another embodiment of this invention.

FIG. 7 illustrates a sheet 140 having opposing strips of dots 142 and 144. The dots 142 and 144 can be arranged to overlay each other or, alternatively, can be arranged so that the dots of one sheet lie between dots of the adjacent overlying sheet.

Figure 8:
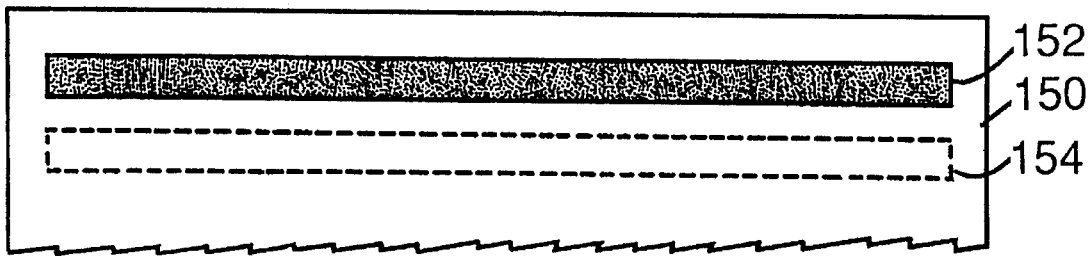
FIG. 8 is a plan view of a solid toner strip pattern for forming a binding area according to yet another embodiment of this invention.

Finally, according to FIG. 8, the toner strips on the sheet 150 can comprise a pair of opposing solid or semi-solid strips 152 and 154. The amount of toner (density) utilized in the strips according to any of the above-described embodiments can be varied in order to vary the strength of the binding joint between sheets. Strength can also be varied by varying the amount of heat and pressure applied to a given sheet. However, it is generally desirable to provide a uniform heat and pressure that insures maximum toner fusion while varying binding strength by providing a discrete toner pattern and density to each sheet. In this manner, substantially more predictable binding strength can be achieved.

In any of the above-described embodiments, the width of a toner strip can be varied depending upon the desired size of the overall binding area of the stack. According to one embodiment, each strip can comprise a ¼ inch width area so that the entire binding area is approximately ½ inch. The strips can be inset from the binding edge by approximately ⅛ to ¼ inch so that the overall binding area extends ¾ inch from the edge. These values should be taken only by way of example. A bind can be made very narrow or very large and overall strength of the bind can be varied to accommodate differing widths based upon the density of toner on a given adhesive strip.

Figure 9:
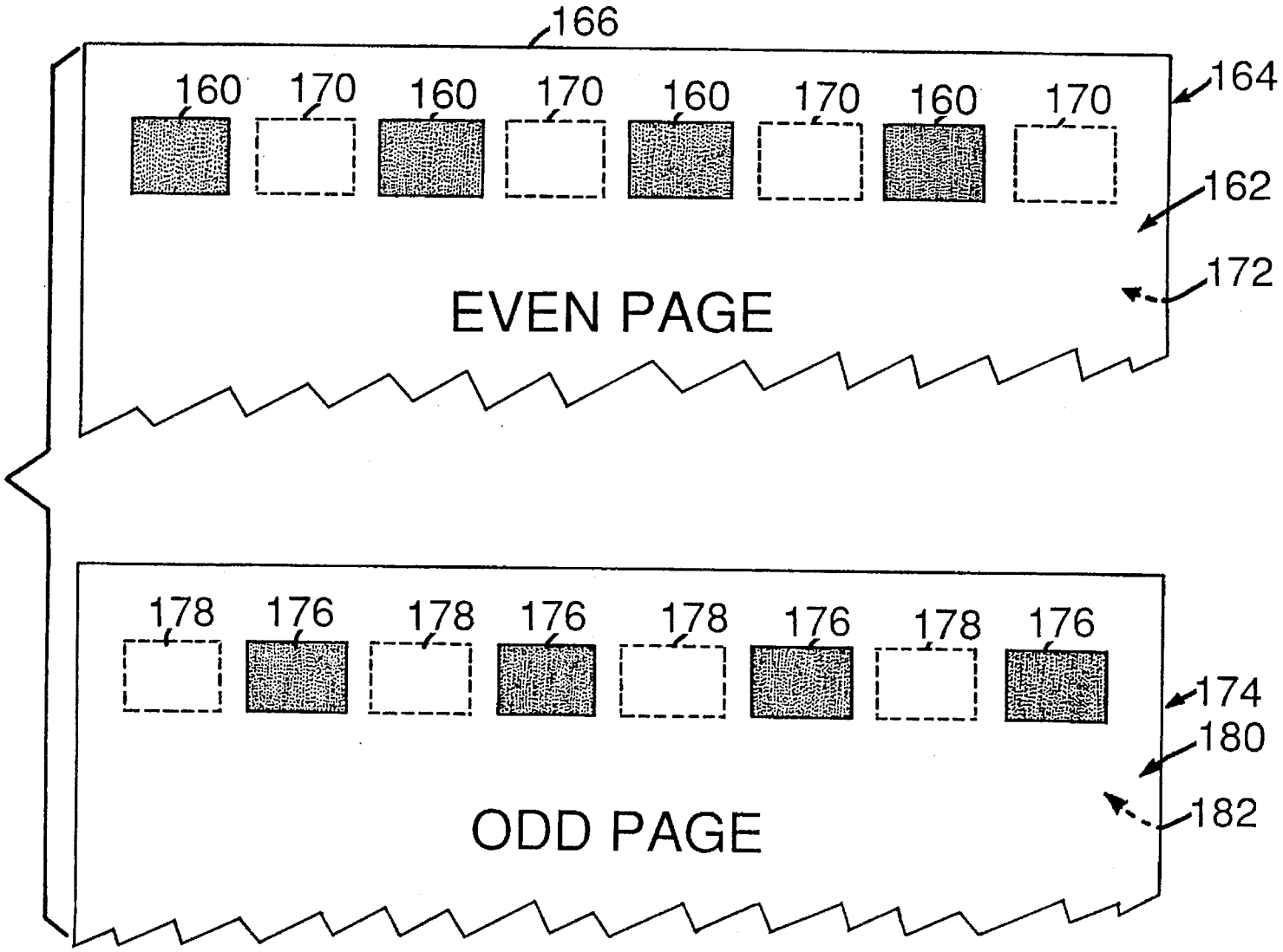
FIG. 9 is a plan view of a dotted toner strip pattern according to another embodiment of this invention.

FIG. 9 illustrates another toner pattern that enables the use of alternating "dots" within a single strip area. In other words, the toner dots are all spaced an approximately equal distance from the binding edge. As depicted, the dots on the front face 162 of the "even" sheet or page 164 are spaced from the binding edge 166 an approximately equal distance as the spacing of the dots 170 (shown in phantom) on the reverse face 172 of the sheet 164. The dots 160 are, however, offset in a direction parallel to the edge 166 relative to the dots 170. Hence, all dots 160 and 170 are disposed along a common line relative to the edge 166, but are free of overlap.

The even sheet is adapted to be joined to the "odd" sheet or page 174. The dots 176 on the front face 180 of the odd sheet 174 are located so that they face the dots 170 of the even sheet 164. Likewise, the dots 178 of the odd sheet are oriented to face the dots 100 of the even sheet 164. Even and odd sheets can be generated and overlayed in an alternating pattern. Thus, the dots joining each pair of sheets are offset from the dots joining the preceding and succeeding pairs of sheets in a stack. In other words, sealing energy applied over a given set of dots can be concentrated on that set while the set immediately below is offset and, thus, isolated from the sealing energy.

Figure 10:
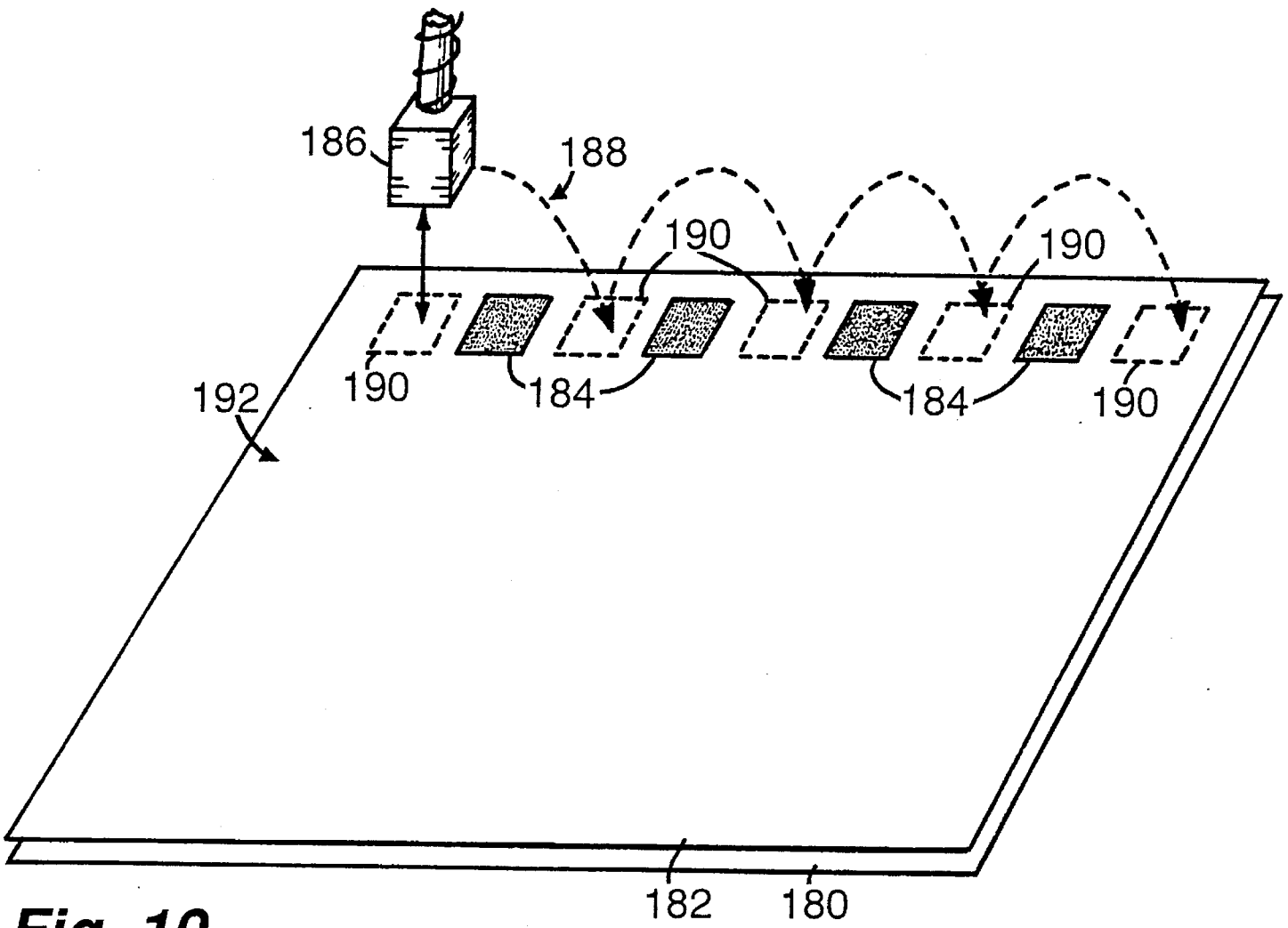
FIGS. 10 and 11 are schematic perspective views of a binding process utilizing the toner strip pattern of FIG. 9.
Figure 11:
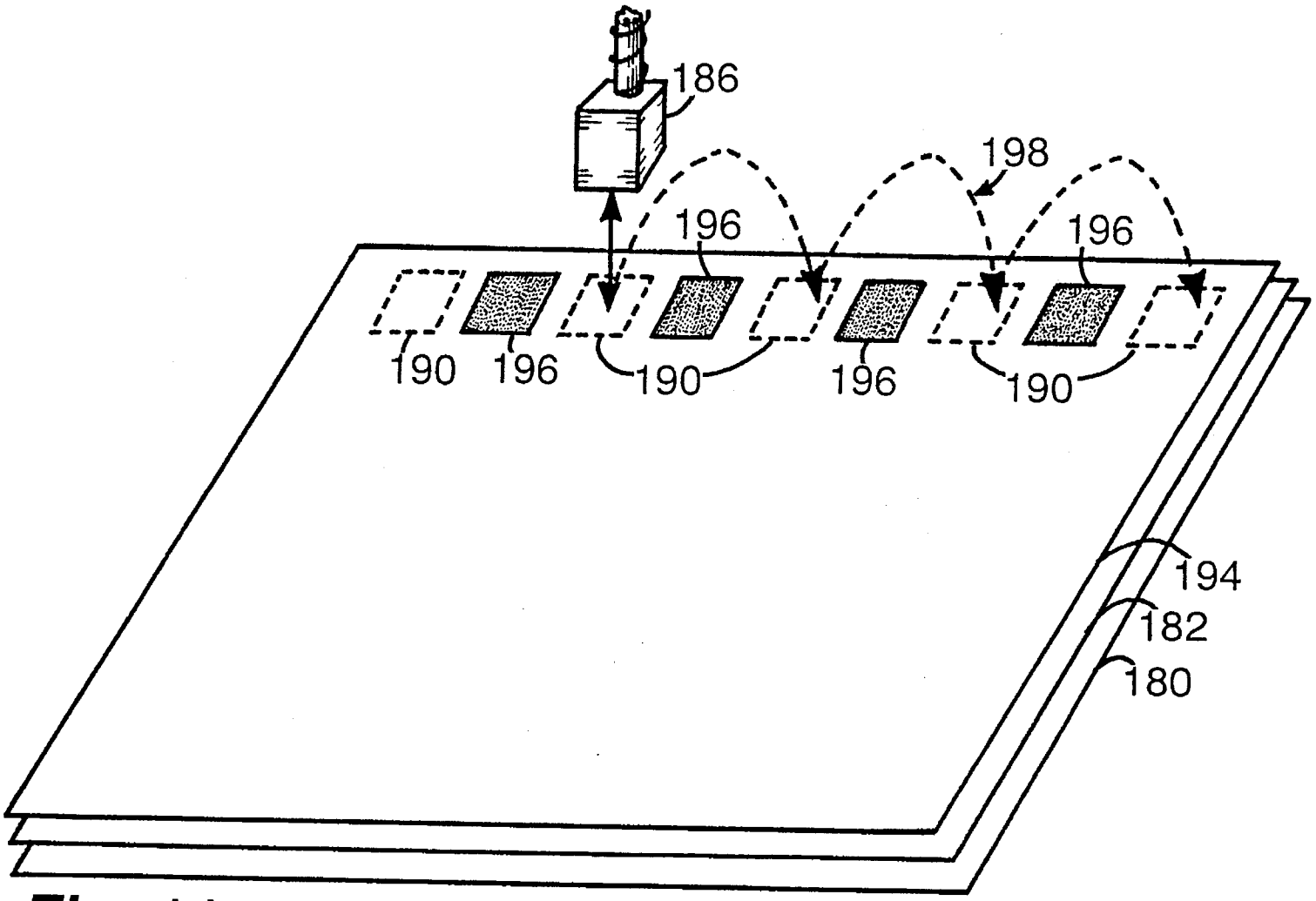

In order to provide isolated sealing energy to a given toner strip, the sealing wheel or platen has been selectively located to apply sealing energy only to a given strip. In the present embodiment, as illustrated in FIG. 9, the dots are all aligned similarly relative to the binding edge of the sheet. FIGS. 10 and 11 illustrate a mechanism for sealing a set of aligned dots. In FIG. 10, two sheets 180 and 182 joined by a pair of confronting dots 184 (shown in phantom). A moving heated platen 186 having an outline that approximates that of the dots 184 moves along a path 188, engaging and withdrawing from the sheets 180 and 182, to apply pressure to the area of the dots 184. The platen 186, hence skips over the alternating dots 190 that are applied to the upwardly-facing sheet face 192. Note that movement of the platen to various locations upon a stack according to this invention can be accomplished by moving either the platen or the stack, or both. Thus the platen 186 can remain stationary and the sheets 180 and 182 can be moved so that selected dots underlie the platen 186.

FIG. 11 illustrates the addition of another sheet 194 to the stack of sheet 180 and 182. The platen 186 is relocated to apply sealing energy to the dots 190 (shown in phantom) which are offset from the upwardly-facing dots 196. The platen follows a movement path 198 that is offset from the path 188 of FIG. 10.

Figure 12:
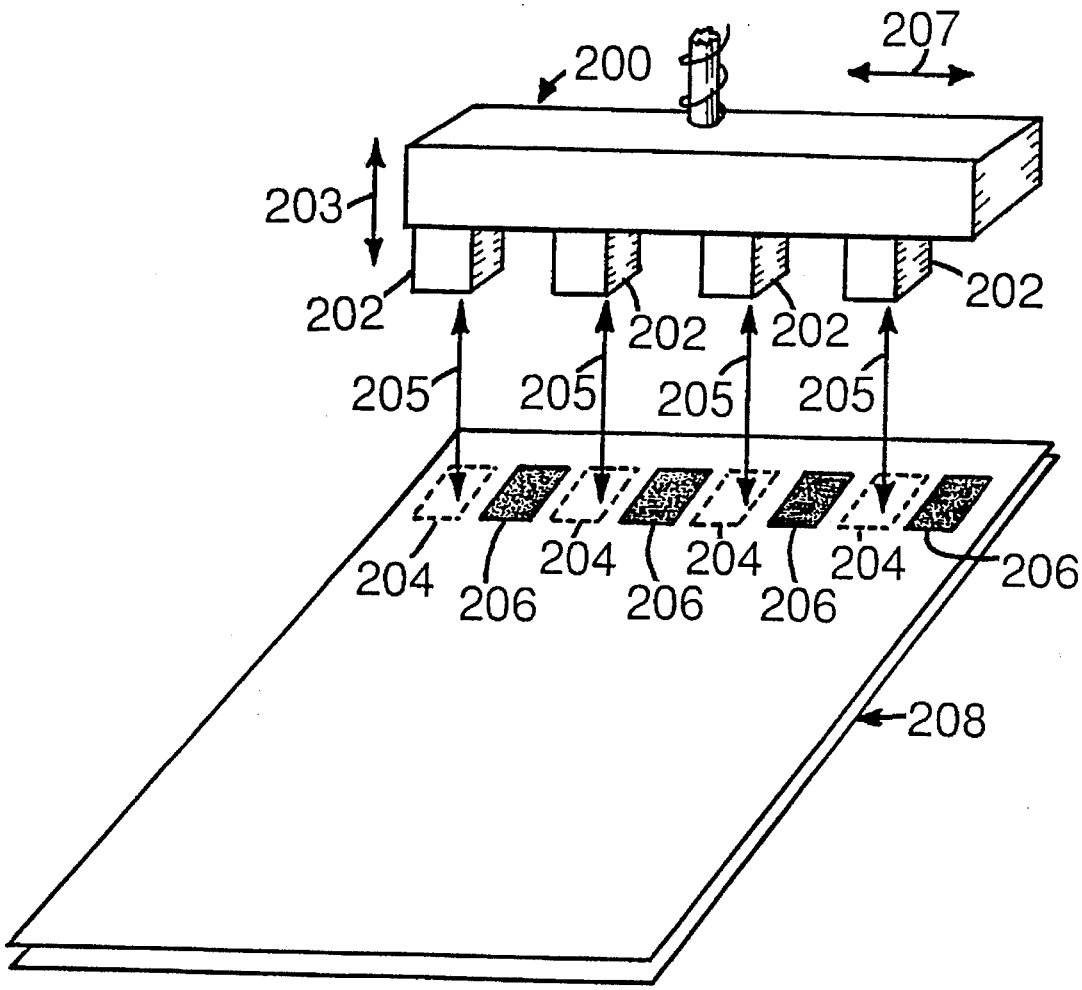
FIG. 12 is a schematic perspective view of a binding process utilizing the toner strip pattern of FIG. 9 according to an alternate embodiment of this invention.

The platen 186 of FIGS. 10 and 11 operates individually on each discrete dot. FIG. 12 illustrates an alternate embodiment in which all dots in a group are sealed simultaneously, the heated platen structure 200 includes a set of spaced platens 202 that approximate the outline of dots. The platens 202 are spaced so that they apply sealing energy (arrows 203 and 205) to one set of dots substantially simultaneously, while avoiding engagement with the oppositely-facing set of offset dots 206. As further sheet are applied to the stack 208, the platen structure 200, or stack is move (arrow 207) so that the platens 202 overlay alternating sets of dots. Such movement is a distance approximately equal to the on-center spacing between a pair of adjacent oppositely-facing dots.

While a movable platen has bee describe hereinabove, it is contemplated that a variety a structures can be utilized to apply sealing energy to desired areas of a stack in this and other embodiments described herein. For example, movable shields can be used to isolate sealing radiation or induction energy to particular dots or strips. Movable chemical applicators that restrict application to a given area are also contemplated. Concentrated energy sources such as coherent light can also be utilized to provide sealing energy according to this invention.

The foregoing has been a detailed description of preferred embodiments. Various modifications and additions can be made to this description without departing from the spirit and scope of the invention. This description is, therefore, meant to be taken only by way of example and not to otherwise limit the scope of the invention. For example, a variety of intermediate processes can be performed upon sheets between printing and final binding. A variety of geometric shapes can be utilized as toner adhesive strips and the term "strip" should be construed to define any number of elongated patterns of toner upon a sheet. Similarly, while a heated sealing platen or wheel is described, it is contemplated that the toner strips can be softened to fuse together by radiant energy or softening agents and a cool press can be utilized to seal the strips together. Additionally, it is contemplated that only one pair of oppositely-facing sheets can be provided with a toner strip, that is sealed to the opposing, unprinted, sheet edge.

What is claimed is:

1. A method for binding sheets comprising:

directing a first sheet through and image transfer device and applying a first strip of printing substance along at least one face of the first sheet;

directing a second sheet through the image transfer device and applying a second strip of printing substance to the second sheet on a face of the second sheet:

directing a third sheet through the image transferred device, at least one of the step of directing the first sheet, directing the second sheet, and directing the third sheet including applying printing to the face of at least one of the respective of the first sheet, the second sheet, and the third sheet;

positioning the first sheet having the first strip at a binding location:

overlaying the second sheet in a selected alignment with the first sheet so that the first strip faces a face of the second sheet;

fusing the first strip to an opposing face of the second sheet, the step of fusing including reactivating the printing substance by applying sealing energy through a face of the second sheet opposite the face that faces the first strip;

overlaying a third sheet in a selected alignment with the second sheet, the third strip facing a face of the third sheet;

fusing the second strip to the face of the third sheet, the step of fusing including reactivating the printing substance by applying the sealing energy through a face of the third sheet opposite the face that opposes the second strip; and wetting at least one of the first sheet and the second sheet prior to the step of fusing to improve heat conduction.

2. The method as set forth in claim 1 wherein at least one of the step of fusing the first strip and the step of fusing the second strip includes applying heat through at least one of the second sheet and the third sheet, respectively.

3. The method as set forth in claim 2 wherein at least one of the step of fusing the first strip and the step of fusing the second strip includes pressurably applying and moving a heated roller, sized and arranged to overlap an outer perimeter of the strip, over an upper face of at least one of the second sheet and the third sheet, respectively.

4. The method as set forth in claim 3 wherein the step of moving includes providing a heated roller having a width that is approximately equal to a width of the strip wherein the wheel is free of contact with text adjacent the strip.

5. The method as set forth in claim 1 further comprising softening at least one of the first strip and the second strip prior to the step of fusing.

6. The method as set forth in claim 5 wherein the step of softening includes preheating the strip.

7. The method as set forth in claim 1 further comprising applying an opposing strip of printing substance to the second sheet, the opposing strip facing the first strip.

8. The method as set forth in claim 7 wherein the step of applying the opposing strip of toner includes aligning the opposing strip with the first strip.

9. The method as set forth in claim 8 wherein the step of applying the first strip and the step of applying the second strip include locating the first strip relative to an edge of the first sheet that is spaced differently than the second strip relative to an edge of the second sheet wherein the first strip is offset relative to the second strip.

10. The method as set forth in claim 9 wherein the step of fusing the first strip and the step of fusing the second strip include moving a fusing element so that it overlies one of the first strip and the second strip and is free of contact with and remote from another of the first strip and the second strip.

11. The method as set forth in claim 1 wherein at least one of the step of applying the first strip and the step of applying the second strip include printing a plurality of side-by-side lines.

12. The method as set forth in claim 1 wherein at least one of the step of applying the first strip and the step of applying the second strip include printing a plurality of dots.

13. The method as set forth in claim 1 wherein at least one of the step of applying the first strip and the step of applying the second strip include printing a plurality of discrete printed shapes of printing substance.

14. An apparatus for binding sheets using printing toner comprising:

an image transfer device that applies printing substance to sheets constructed and arranged to apply printing to the sheets and to apply a strip of printing substance adjacent an edge of each of the sheets;

an overlay location position down stream of the image transfer device that receives the sheets, each having the strip thereon;

a fuser that reactivates each of the sheets including a source of sealing energy that transfers ceiling energy to each of a pair of the sheets in an overlapping adjacent orientation at the overlay location, the fuser applying sealing energy in the area of the strip so that toner in the strip of one of the pair of sheets is fused to a face of the adjacent of the pair of sheets, the fuser applying pressure as each of the sheets is overlaid onto a preceding sheet at the overlay location to form a stack thereby; and a wetting element that wets each of the sheets in an area of the strip to enhance heat transferred to the strip.

15. The apparatus as set forth in claim 14 wherein the fuser includes a heating element for applying heat through each of the sheets reactivate and fuse printing substance in the strip.

16. The apparatus as set forth in claim 14 wherein the image transfer device is constructed and arranged to apply strips of printing substance to each of two opposing faces of the sheets at locations adjacent edges thereof wherein each of a plurality of adjacent sheets at the overlay location include toner strips that engage and face each other.

17. The apparatus as set forth in claim 16 wherein the image transfer device is constructed and arranged to apply strips of printing substance on each of the two opposing faces of the sheets in an offset relationship so that the fuser is remote from one of the strips when it applies sealing energy in an area of another of the strips of each of the sheets.

18. The apparatus as set forth in claim 14 wherein the fuser comprises a heated platen that pressurably engages and withdraws from each of the sheets.

19. The apparatus as set forth in claim 18 wherein the heated platen is constructed and arranged to move between a pair of offset strips of printing substance located at different spacings relative to an edge of each of the sheets to independently fuse each of the offset strips.

20. The apparatus as set forth in claim 14 wherein the fuser comprises a heated wheel that pressurably moves along the area of the strip of each of the sheets.

21. The apparatus as set forth in claim 20 wherein the heated wheel is constructed and arranged to move between a pair of offset strips of printing substance located at different spacings relative to an edge of each of the sheets to independently fuse each of the offset strips.

22. The apparatus as set in claim 14 further comprising a preheat station for softening the printing substance in the strips as each of the sheets is received at the overlay location.

23. The apparatus as set in claim 14 wherein the fuser comprise a heated wheel having a concave surface therein sized so that printing substance in the strip is maintained substantially adjacent edges of the sheet wheel when the wheel applies pressure in the area of the strip.

24. The apparatus as set in claim 14 wherein the printing substance comprises a xerographic toner.

25. A method for binding sheets using a reactivatable printing substance comprising the steps of:

applying printing to each of a plurality of sheets with a reactivatable printing substance including applying a strip of printing substance adjacent in edge of each of the plurality of sheets;

directing each of the plurality of sheets in sequence to an overlay location and each of the plurality of sheets at the overlay location;

reactivating printing toner in the strip of each of the plurality of sheets as a succeeding sheet is overlaid onto the plurality of sheets and fusing the strip to the succeeding sheet to form a bound stack thereby; and providing an additive to the printing substance that enhances reactivation of the printing substance including wetting each of the plurality of sheets in an area of the strip to enhance conductivity of the area to heat.

26. The method as set forth in claim 25 wherein the step of applying a strip includes applying a strip to each of a pair of opposite faces of each of the plurality of sheets and locating the strip so that each of the strips on opposing faces of each of the plurality of sheets engages a strip on an adjacent sheet at the overlay location so that a pair of opposing strips are fused by the step of reactivating.

27. The method as set forth in claim 26 wherein the step of applying includes applying each of the strips to opposing faces of each of the plurality of sheets so that each of the strips are offset from each other and are free of overlap relative to one another.

28. The method as set forth in claim 25 wherein the step of applying comprising printing the sheet with a xerographic toner-applying image transfer element.

29. The method as set forth in claim 25 wherein the step of reactivating comprises heating the printing substance to cause the printing substance to flow and wherein the step of fusing includes cooling of the printing substance subsequent to heating.

30. The method as set forth in claim 25 further comprising softening the strip in each of the plurality of sheets prior to locating the sheets at the overlay position.

31. The method as set forth in claim 30 wherein the printing substance comprises a heat-activated toner and wherein the step of preheating comprises applying heat to the strips.

* * * * *